US011454414B2

(12) United States Patent
Allahar et al.

(10) Patent No.: US 11,454,414 B2
(45) Date of Patent: Sep. 27, 2022

(54) RAIN ACTIVATED FAN SYSTEM

(71) Applicant: Carrier Corporation, Jupiter, FL (US)

(72) Inventors: Kerry Allahar, Syracuse, NY (US); Matthew Patterson, East Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 323 days.

(21) Appl. No.: 16/631,939

(22) PCT Filed: Jul. 12, 2018

(86) PCT No.: PCT/US2018/041722
§ 371 (c)(1),
(2) Date: Jan. 17, 2020

(87) PCT Pub. No.: WO2019/018187
PCT Pub. Date: Jan. 24, 2019

(65) Prior Publication Data

US 2020/0224917 A1 Jul. 16, 2020

Related U.S. Application Data

(60) Provisional application No. 62/534,381, filed on Jul. 19, 2017.

(51) Int. Cl.
*F24F 11/871* (2018.01)
*F24F 11/64* (2018.01)
(Continued)

(52) U.S. Cl.
CPC ..... *F24F 11/871* (2018.01); *F24F 11/61* (2018.01); *F24F 11/64* (2018.01); *F24F 2130/10* (2018.01)

(58) Field of Classification Search
CPC ..... F24F 11/871; F24F 11/61; F24F 11/64; F24F 2130/10; F24F 11/30; F24F 2221/225
See application file for complete search history.

(56) References Cited

U.S. PATENT DOCUMENTS 3,943,728 A 3/1976 Maudlin
4,010,577 A 3/1977 Stalter
(Continued)

FOREIGN PATENT DOCUMENTS

CN 2869660 Y 2/2007
CN 103673204 A 3/2014
(Continued)

OTHER PUBLICATIONS

Domestic Group AB, "Standard Features and Options for Fan-Tastic Vent Controllers", Fan-Tastic Vent, vailable at: https://www.dometic.com/en-us/us/products/ciimate/ventilation-solutions/rv-roof-vents, accessed Jan. 15, 2020, 4 pages.
(Continued)

*Primary Examiner* — Lionel Nouketcha
(74) *Attorney, Agent, or Firm* — Cantor Colburn LLP

(57) ABSTRACT

A method and system of activating a fan for an air conditioning system is disclosed. Upon the sensing of rain in the proximity of the air conditioning system, such as a condenser, a fan is activated. The fan is configured to drive air and rain through the condenser. The fan can be configured to operate periodically or for a pre-set amount of time while rain is being sensed.

17 Claims, 5 Drawing Sheets

(51) Int. Cl.
*F24F 11/61* (2018.01)
*F24F 130/10* (2018.01)

(56) References Cited

U.S. PATENT DOCUMENTS

| | | | | |
|---|---|---|---|---|
| 4,193,269 | A * | 3/1980 | Barry | G05D 23/1927 236/75 |
| 5,131,463 | A | 7/1992 | Zimmerli et al. | |
| 5,186,240 | A | 2/1993 | Kennon et al. | |
| 6,318,108 | B1 | 11/2001 | Holstein et al. | |
| 6,646,560 | B1 | 11/2003 | Krasenics, Jr. | |
| 6,666,038 | B1 | 12/2003 | Hynes | |
| 7,520,444 | B1 | 4/2009 | Hall et al. | |
| 2012/0221150 | A1 | 8/2012 | Arensmeier | |

FOREIGN PATENT DOCUMENTS

| | | | |
|---|---|---|---|
| CN | 204282074 | U | 4/2015 |
| CN | 104729356 | A | 6/2015 |
| CN | 105318452 | A | 2/2016 |
| CN | 105674478 | A * | 6/2016 |
| CN | 105674478 | A | 6/2016 |
| CN | 105827195 | A | 8/2016 |
| IE | 20070331 | A1 | 11/2007 |
| JP | H04371768 | A | 12/1992 |
| WO | 2013020579 | A1 | 2/2013 |
| WO | 2013113139 | A1 | 8/2013 |
| WO | 2016020705 | A1 | 2/2016 |

OTHER PUBLICATIONS

International Search Report and Written Opinion for application PCT/US2018/041722, dated Sep. 28, 2018, 13 pages.

* cited by examiner

RAIN ACTIVATED FAN SYSTEM

BACKGROUND

The present disclosure relates in general to air conditioning systems. More specifically, this disclosure relates to the reduction of corrosion in an air conditioning system.

Air conditioning systems are well-known in the art and commonly used to cool the air in homes, apartments, commercial buildings, hospitals, restaurants, and the like. A conventional air conditioning system includes one or more refrigeration units having respective closed loop refrigeration circuits. Each refrigeration unit includes one or more compressors, an air-cooled condenser, an expansion device and an evaporator, disposed in a closed-loop refrigerant circuit. Refrigerant is evaporated as it passes through the respective evaporators.

The air-cooled condensers of air conditioning systems can include a heat exchanger tube coil through which high-pressure, high-temperature refrigerant vapor is conveyed in a heat exchange relationship with ambient outdoor air that is passed through the heat exchanger tube coil over the refrigerant conveying tubes. One or more fans can be provided in operative association with the condenser heat exchanger in either a forced air or an induced draft arrangement.

BRIEF DESCRIPTION

According to one embodiment, a method includes sensing rain in a proximity of an air conditioning unit; powering a fan, the fan configured to push or pull air and the rain through the air conditioning unit.

In addition to one or more of the features described above, or as an alternative, further embodiments may include wherein: the fan is powered for a predetermined amount of time upon the sensing of rain.

In addition to one or more of the features described above, or as an alternative, further embodiments may include wherein the predetermined amount of time is less than one hour.

In addition to one or more of the features described above, or as an alternative, further embodiments may include wherein the fan is configured to turn on in a periodic manner while rain is being sensed.

In addition to one or more of the features described above, or as an alternative, further embodiments may include determining a most recent sensing of rain; wherein: powering the fan only occurs if the most recent sensing of rain is greater than a predetermined amount of time or amount of rain.

In addition to one or more of the features described above, or as an alternative, further embodiments may include wherein the predetermined amount of time is approximately one week.

In addition to one or more of the features described above, or as an alternative, further embodiments may include wherein sensing rain comprises receiving a forecast of rain, including a forecast time of a commencement of rain; wherein: powering the fan occurs at the forecast time of the commencement of rain.

According to one embodiment, a system includes a condenser of an air conditioning system; a rain sensor; and a fan coupled to the rain sensor; wherein: the fan is configured to operate upon a sensing of rain by the rain sensor; and the fan is configured to drive air and rain through the condenser.

In addition to one or more of the features described above, or as an alternative, further embodiments may include a controller coupled between the rain sensor and the fan; wherein: the controller is configured to cause the fan to operate for a predetermined amount of time upon the sensing of rain.

In addition to one or more of the features described above, or as an alternative, further embodiments may include wherein the predetermined amount of time is less than one hour.

In addition to one or more of the features described above, or as an alternative, further embodiments may include wherein the fan is configured to turn on in a periodic manner while rain is being sensed.

In addition to one or more of the features described above, or as an alternative, further embodiments may include determining a most recent sensing of rain; wherein: powering the fan only occurs if the most recent sensing of rain is greater than a predetermined amount of time or amount of rain.

According to one embodiment, a computer program product comprises a computer readable storage medium having program instructions embodied therewith, wherein the computer readable storage medium is not a transitory signal per se, the program instructions executable by a processor to cause the processor to: receive an indication of rainfall in a proximity of a condenser of an air conditioning unit; and cause the powering a fan upon receiving the indication of rainfall, the fan configured to push or pull air and the rain through the condenser.

In addition to one or more of the features described above, or as an alternative, further embodiments may include wherein the fan is powered for a predetermined amount of time upon the sensing of rain.

In addition to one or more of the features described above, or as an alternative, further embodiments may include wherein the predetermined amount of time is less than one hour.

In addition to one or more of the features described above, or as an alternative, further embodiments may include wherein the fan is configured to turn on in a periodic manner while rain is being sensed.

In addition to one or more of the features described above, or as an alternative, further embodiments may include wherein the program instructions are further configured to: determine a most recent sensing of rain; wherein: causing powering the fan only occurs if the most recent sensing of rain is greater than a predetermined amount of time or amount of rain.

In addition to one or more of the features described above, or as an alternative, further embodiments may include wherein receiving an indication of rainfall sensing rain comprises: receiving a forecast of rain, including a forecast time of a commencement of rain; wherein: causing powering the fan occurs at the forecast time of the commencement of rain.

Technical effects of embodiments of the disclosure include a system that reduces corrosion by sensing rain in the proximity of an air conditioning system and turns a fan on to direct air and rain through the condenser that results in the rinsing of potential contaminants from the condenser.

These and other advantages and features will become more apparent from the following description taken in conjunction with the drawings.

Additional features are realized through the techniques of the present disclosure. Other embodiments are described in detail herein and are considered a part of the claims. For a better understanding of the disclosure with the features, refer to the description and to the drawings.

BRIEF DESCRIPTION OF THE DRAWINGS

The subject matter which is regarded as the disclosure is particularly pointed out and distinctly claimed in the claims at the conclusion of the specification. The forgoing features are apparent from the following detailed description taken in conjunction with the accompanying drawings in which:

Figure 1:
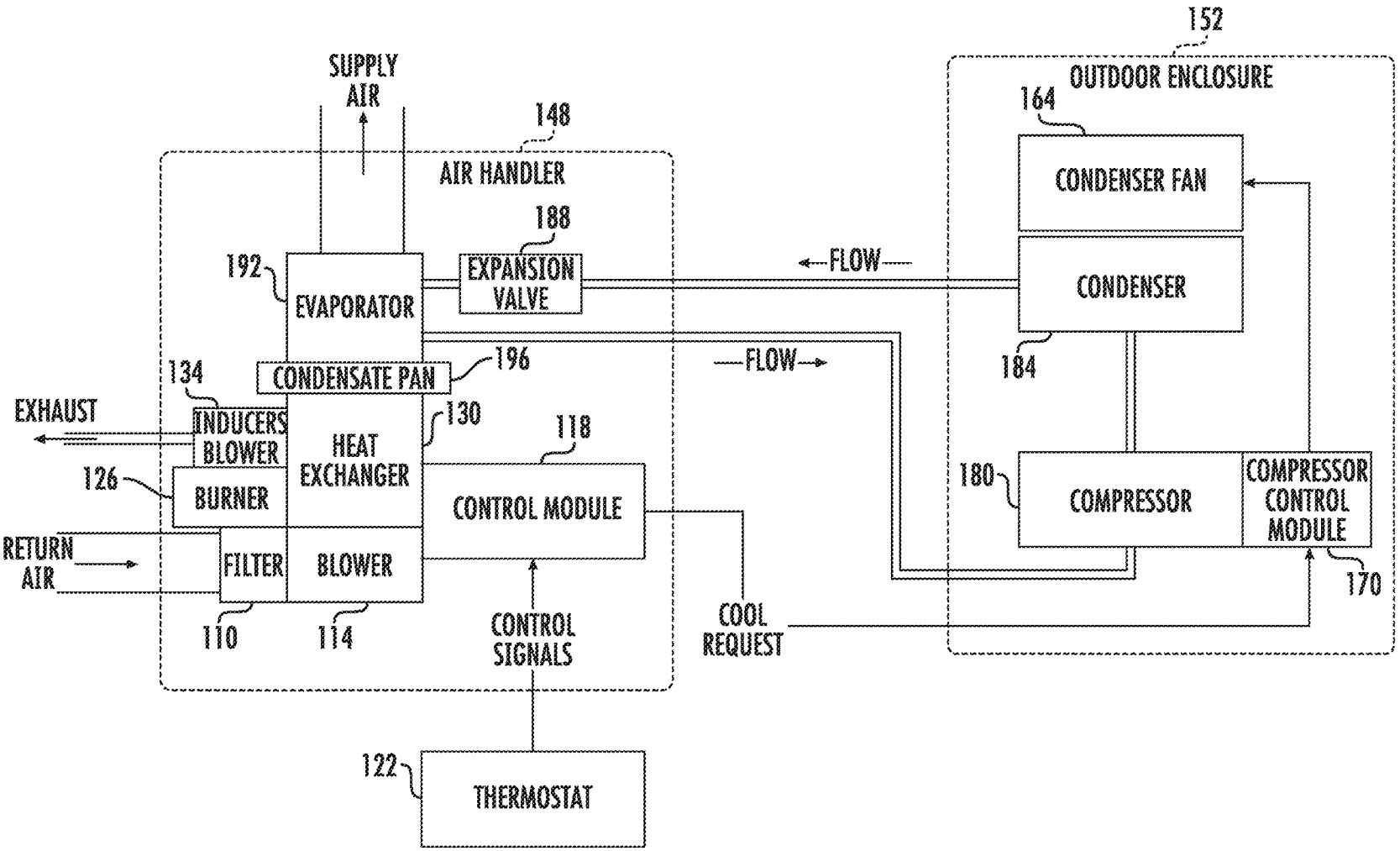
FIG. 1 is a block diagram illustrating a heating, ventilation, and air-conditioning (HVAC) system of one or more embodiments.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood that this disclosure is no limited to the particular embodiments illustrated herein.

DETAILED DESCRIPTION

Various embodiments will now be described with reference to the related drawings. Alternate embodiments may be devised without departing from the scope of this detailed description. Various connections might be set forth between elements in the following description and in the drawings. These connections, unless specified otherwise, may be direct or indirect, and the present description is not intended to be limiting in this respect. Accordingly, a coupling of entities may refer to either a direct or an indirect connection.

Referring to FIG. 1, a block diagram of an exemplary HVAC (heating, ventilation, and air conditioning) system is presented. In this particular example, a forced air system with a gas furnace is illustrated. Return air is pulled from the residence through a filter 110 by a blower 114. The blower 114, also referred to as a fan, is controlled by a control module 118. The control module 118 receives signals from a thermostat 122.

Thermostat 122 may direct that the blower 114 be turned on at all times or only when a heat request or cool request is present. The blower 114 may also be turned on at a scheduled time or on demand. Thermostat 122 also provides the heat and/or cool requests to the control module 118. When a heat request is made, the control module 118 causes a burner 126 to ignite. Heat from combustion is introduced to the return air provided by the blower 114 in a heat exchanger 130. The heated air is supplied to the residence and is referred to as supply air.

The burner 126 may include a pilot light, which is a small constant flame for igniting the primary flame in the burner 126. Alternatively, an intermittent pilot may be used in which a small flame is first lit prior to igniting the primary flame in the burner 126. A sparker may be used for an intermittent pilot implementation or for direct burner ignition. Another ignition option includes a hot surface igniter, which heats a surface to a high enough temperature that when gas is introduced, the heated surface causes combustion to begin. Fuel for combustion, such as natural gas, may be provided by a gas valve (not shown).

The products of combustion are exhausted outside of the residence, and an inducer blower 134 may be turned on prior to ignition of the burner 126. The inducer blower 134 provides a draft to remove the products of combustion from the burner 126. The inducer blower 134 may remain running while the burner 126 is operating. In addition, the inducer blower 134 may continue running for a set period of time after the burner 126 turns off. In a high efficiency furnace, the products of combustion may not be hot enough to have sufficient buoyancy to exhaust via conduction. Therefore, the inducer blower 134 creates a draft to exhaust the products of combustion.

A single enclosure, which will be referred to as an air handler 148, may include the filter 110, the blower 114, the control module 118, the burner 126, the heat exchanger 130, the inducer blower 134, the expansion valve 188, the evaporator 192, and the condensate pan 196.

In the HVAC system of FIG. 1, a split air conditioning system is also shown. Refrigerant is circulated through a compressor 180, a condenser 184, an expansion valve 188, and an evaporator 192. The evaporator 192 is placed in series with the supply air so that when cooling is desired, the evaporator removes heat from the supply air, thereby cooling the supply air. During cooling, the evaporator 192 is cold, which causes water vapor to condense. This water vapor is collected in a condensate pan 196, which drains or is pumped out.

A compressor control module 170 receives a cool request from the control module 118 and controls the compressor 180 accordingly. The compressor control module 170 also controls a condenser fan 164, which increases heat exchange between the condenser 184 and outside air. In such a split system, the compressor 180, the condenser 184, the compressor control module 170, and the condenser fan 164 are located outside of the residence, often in a single outdoor enclosure 152.

In various implementations, the compressor control module 170 may simply include a run capacitor, a start capacitor, and a contactor or relay. In fact, in certain implementations, the start capacitor may be omitted, such as when a scroll compressor instead of a reciprocating compressor is being used. The compressor 180 may be a variable capacity compressor and may respond to a multiple-level cool request. For example, the cool request may indicate a mid-capacity call for cool or a high-capacity call for cool.

The electrical lines provided to the outdoor enclosure 152 may include a 240 volt mains power line and a 24 volt switched control line. The 24 volt control line may correspond to the cool request shown in FIG. 1. The 24 volt control line controls operation of the contactor. When the control line indicates that the compressor should be on, the contactor contacts close, connecting the 240 volt power supply to the compressor. In addition, the contactor may connect the 240 volt power supply to a condenser fan 164. When the 240 volt mains power supply arrives in two legs, as is common in the U.S., the contactor may have two sets of contacts, and is referred to as a double-pole single-throw switch.

As described above, a condenser includes condenser coils, which commonly include metal parts. A condenser can be located in an outdoor environment in order to exchange heat from the refrigerant within the coils to ambient outdoor air. Because the metal parts of the condenser are located in an outdoor environment, they are potentially subject to corrosion-inducing environmental conditions. This can be exacerbated in coastal areas, where proximity to sea can include proximity to sea salt.

It has been found that rinsing the condenser coils on a periodic basis can help prevent corrosion from forming. While a user (such as a homeowner or landlord) can manually rinse the condenser coils, an automated method of rinsing condenser coils can be beneficial.

Rainwater can provide the periodic rinsing. However, in embodiments where the condenser coils are substantially vertical, rainwater might not provide a full rinsing of the condenser coils.

Turning now to an overview of an embodiment, a rain sensing system can be coupled to the fan of an air conditioning unit, such as a condenser. Upon the detection of rain, the fan of an air conditioning condenser system can be operated to drive rainwater through the condenser, providing a rinse of potential corrosives from the condenser coils.

Figure 2:
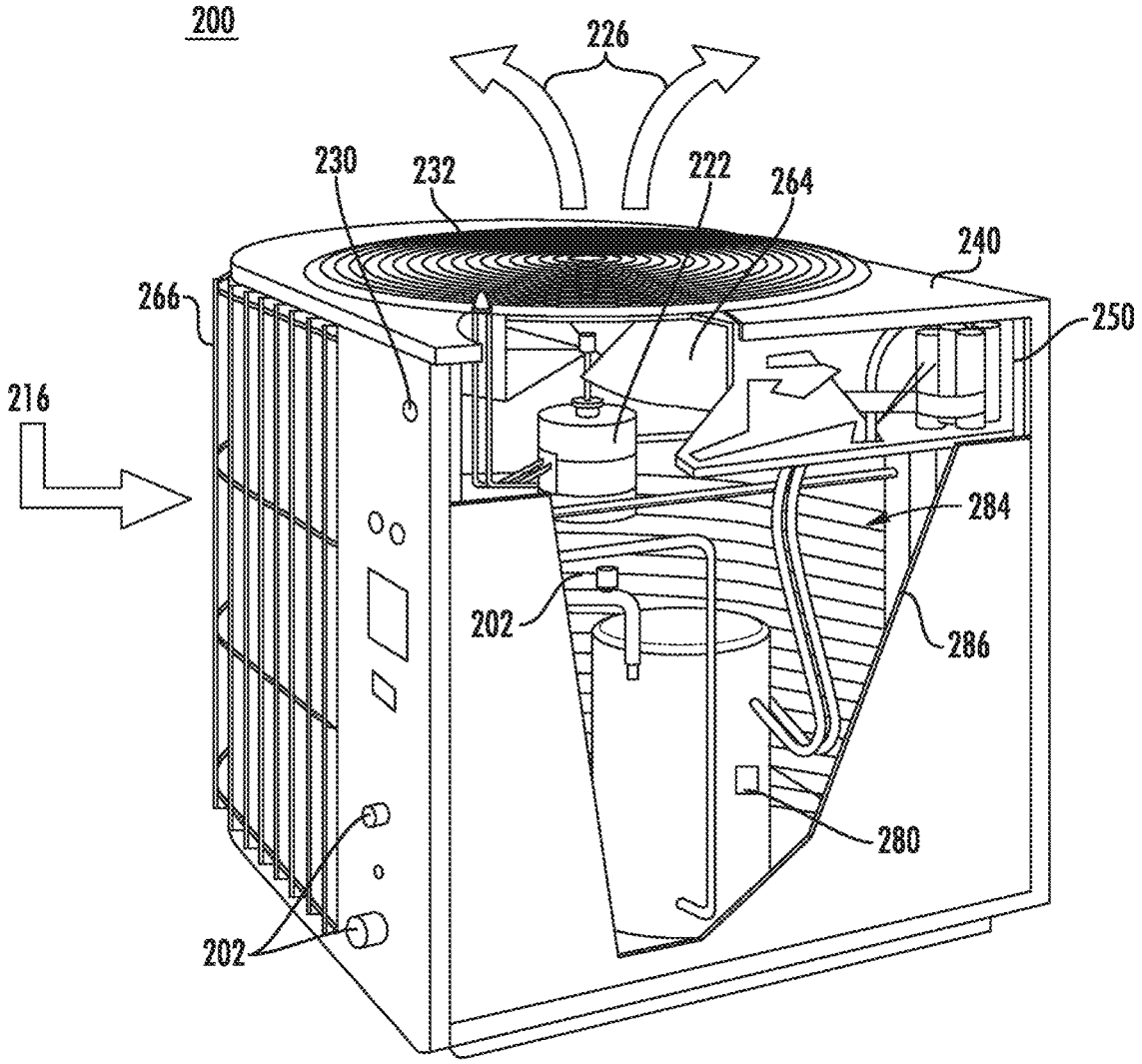
FIG. 2 is a diagram illustrating an outdoor enclosure including a condenser of one or more embodiments.

With reference to FIG. 2, an outdoor enclosure 200 including a condenser is illustrated. Outdoor enclosure 200 includes elements illustrated as outdoor enclosure 152 in FIG. 1. Condenser coils 286 are encased in condenser fins 284 to provide additional surface area for heat transfer. Air flow is input in a direction illustrated by arrow 216 and output in a direction illustrated by arrow 226. It should be understood that, in some embodiments, the air flow is reversed, such that air is input through the top of outdoor enclosure 200 and output through the condenser out the side of outdoor enclosure 200.

The air flow is directed by fan 264, powered by fan motor 262. Fan cover 232 protects users from blades of fan 264. A protective grill 266 protects condenser fins 284 and condenser coils 286. Also present in outdoor enclosure 200 is compressor 280, which serves to compress the coolant. Coolant travels to and from outdoor enclosure 200 via refrigerant line couplings 204. Also present can be a fan control 230 and a manual reset 202. Additional couplings, such as power supply and control signals, may be present, but are not illustrated in FIG. 2.

Various wiring couples together compressor 280 and fan motor 262 at compressor control module 250. In some embodiments, compressor control module 250 can be coupled to and used in conjunction with a control module (such as control module 118) that is located in a building interior. Control module 118 typically contains processing capabilities as will be discussed in further detail below with respect to FIG. 3.

In a use case, fan motor 262 can be configured to turn on when compressor 280 turns on. In one or more embodiments, an additional use case turns on fan motor 262 when rain is sensed.

In some embodiments, a rain sensor 240 is coupled to control module 118. In some embodiments, the coupling can occur via compressor control module 250. The rain sensor 240 can be located in a variety of different locations. As illustrated in FIG. 2, rain sensor 240 is located on fan cover 232. In some embodiments, rain sensor 240 can be located remotely from outdoor enclosure 200. Any type of rain sensor can be used to fulfill the functions of rain sensor 240, both those now known and those developed in the future. In some embodiments, rain sensor 240 may include a hygroscopic disk. When the hygroscopic disk gets wet (such as via rainfall), the hygroscopic disk expands. The expanded disk triggers an indication that rain is falling. In some embodiments, rain sensor 240 is coupled to compressor control module 250 via a wire. In some embodiments, rain sensor 240 is coupled to compressor control module 250 via a wireless connection (e.g., Bluetooth, WiFi, cellular, a proprietary wireless protocol, and the like). In some embodiments, rain sensor 240 is coupled to control module 118.

When rain sensor 240 senses rain, fan motor 262 is turned on, causing fan 264 to turn. Fan 264 forces air and rainwater through condenser coils 286 and condenser fins 284. Since the rainwater is fresh water, salt and other corrosion inducing materials are rinsed away from condenser coils 286 and condenser fins 284. Such a configuration works whether the air (and rainwater) is input through the sides of outdoor enclosure 200 and output through the top or if the air (and rainwater) is input through the top of outdoor enclosure 200 and output through the sides.

The powering on of fan 264 can occur in one of a variety of different manners. In some embodiments, the powering on can be as simple as turning the fan on whenever rain is sensed. Such an embodiment might not use any computations or programming, merely having a rain sensor coupled to a method of turning on fan 264 (such as a mechanical switch, a relay, or an electronic switch). In other embodiments, more sophisticated methodologies can be used to control fan 264. In some embodiments, computational or other programmable devices can be used, such as coupling rain sensor 240 to control module 118 (either directly or via compressor control module 250).

Through the use of control module 118, various programming can be used to control when fan 264 is turned on and for how long. In some embodiments, when fan 264 is turned on, it is turned on for a brief period of time, such as one-half hour to one hour. It may be found that the benefits that occur from rinsing condenser coils 286 and condenser fins 284 occur mainly from the initial rinsing and the further rinsing past that point is less effective. Thus, turning on fan 264 for only a brief period of time saves energy and lengthens the life of fan motor 262.

In other embodiments, fan 264 can be turned on in a periodic fashion. For example, during a prolonged amount of rain, fan 264 can be programmed to turn on for 30 minutes, then turn off for 30 minutes, then turn on for 30 minutes, and so on. The length of time fan 264 is turned on for may or may not be equal to the length of the time fan 264 is turned off. In some embodiments, this periodic operation can be programmed to occur a set number of times. In some embodiments, this periodic operation can be programmed to occur only while rain is still occurring.

In some embodiments, control module 118 can keep track of the last time rain sensor 240 indicated the presence of rain. If the most recent occurrence of rain was within a certain time period (such as one week) control module 118 can be configured not to turn on fan 264. Other use cases can be set forth that varies depending on the local weather conditions that the condenser experiences. For example, condensers that are located in coastal regions might be programmed to run more often than condensers that are located in desert regions.

The programming of control module 118 can take place in any manner now known or developed in the future. In some embodiments, control module 118 includes a processor that can be programmed using one of a variety of different programming languages. Control module 118 can also include one or more types of storage. In some embodiments, control module 118 can include an Internet connection that allows control module 118 to store and receive data to and from a remote location. In some embodiments, control module 118 can be roughly described as a system such as system 300, described below.

In embodiments where control module 118 includes an Internet connection, an alternative method can be used to sense rain. Instead of or in addition to relying on rain sensor 240, control module 118 can receive a weather forecast from the Internet. In such an embodiment, a weather forecast that indicates a possibility of rain greater than a predetermined percentage can result in turning on fan 264. The weather forecast can include a forecast of when the rain starts. Therefore, the fan 264 can be configured to turn on when the rain is forecast to start or at a preset time following the forecasted start time.

Figure 5:
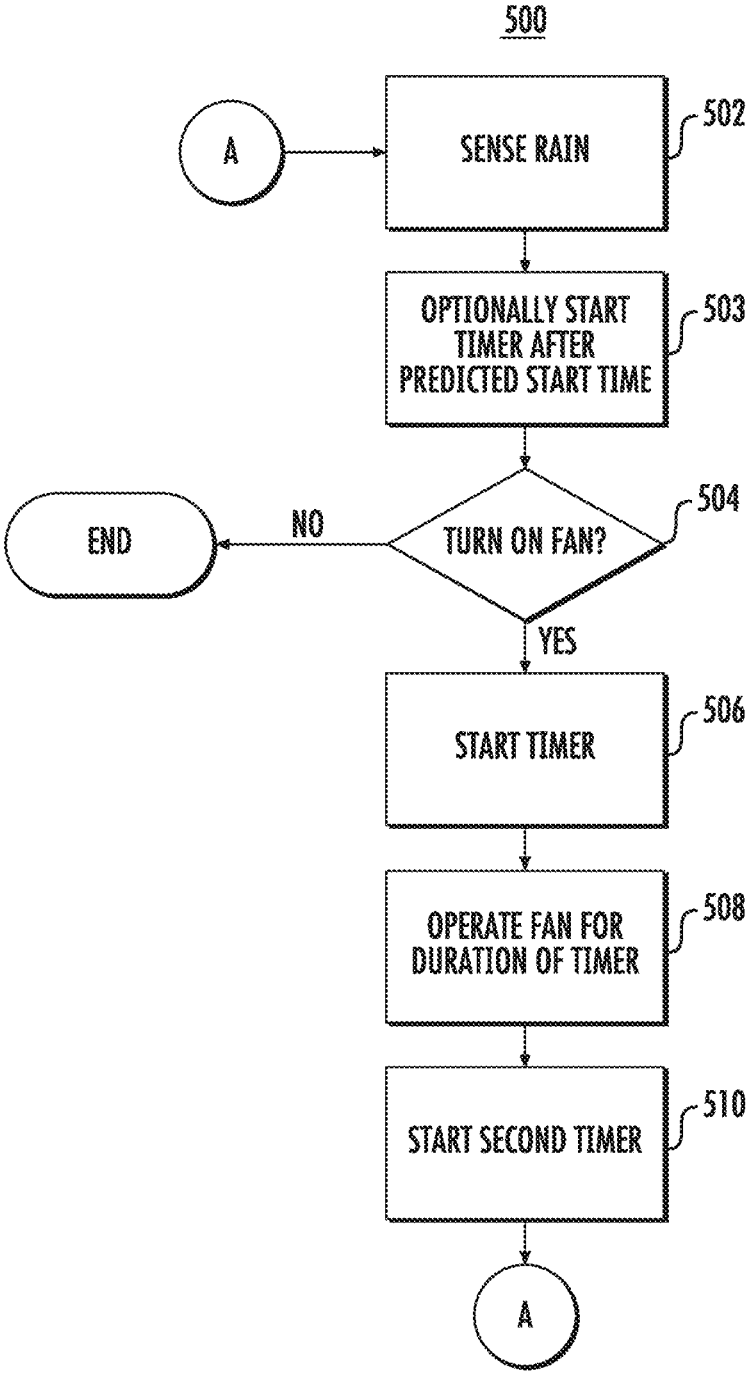
FIG. 5 is a flowchart illustrating the operation of one or more embodiments.

Turning now to FIG. 5, which depicts a flowchart illustrating a method 500 that is merely exemplary and is not limited to the embodiments presented herein. Method 500 can be employed in many different embodiments or examples not specifically depicted or described herein. In some embodiments, the procedures, processes, and/or activities of method 500 can be performed in the order presented. In other embodiments, one or more of the procedures, processes, and/or activities of method 500 can be combined or skipped.

Rain is sensed in the proximity of an air conditioning unit (block 502). As described above, the sensing can occur in one of a variety of different manners. In some embodiments, a physical rain sensor can be placed in proximity of the condenser to sense the rain. In some embodiments, a remote location such as a weather station can sense rain. In some embodiments, the sensing of the rain also can start the measurement of the amount of rain. In some embodiments, a weather forecast can note a predicted start time for rain. In some embodiments, the start time can be a preset time following the forecasted predicted start time (block 503). In some embodiments, the weather forecast also can note a predicted amount of rain. This start time can serve as the sensing of rain.

It is determined if the fan should be operated (block 504). A variety of different factors can be used for this determination. For example, each time the fan is turned on because of rain can be tracked. If the most recent time the fan was used was within a predetermined time period, it may be decided that the fan should not turn on. In such a case, the method will end.

If it is determined that the fan should be turned on, then a timer can be started (block 506). The timer can be of a predetermined length. The length of time might be location dependent. Thus, a condenser near a coastal area might have a longer timer than one located in a less corrosive environment. The fan is operated for the duration of the timer (block 508). In some embodiments, the amount of rain also can be determined and serve as a basis for the duration of the fan. For example, the fan can operate until a certain amount of rain has fallen.

Upon the expiration of the timer, a variety of actions can occur. In some embodiments, a second timer is started (block 510). While the second timer is active, the fan will not turn on. After expiration of the second timer, operation can begin again at block 502. In some embodiments, the amount of rain can be used in place of or in conjunction with a length of time. In some embodiments, method 500 can end after the first operation of the fan. In some embodiments, method 500 can end after the second operation of the fan. Any number of iterations can be chosen as a limit.

From the foregoing, it can be seen that the rain sensing system and method described herein has industrial applicability in a variety of settings involving the use of air conditioning condensers in outdoor environments. Using the teachings of the present disclosure, a rain sensing system may be constructed to reduce corrosion and lengthen the lifespan of components of an air conditioning system.

Figure 3:
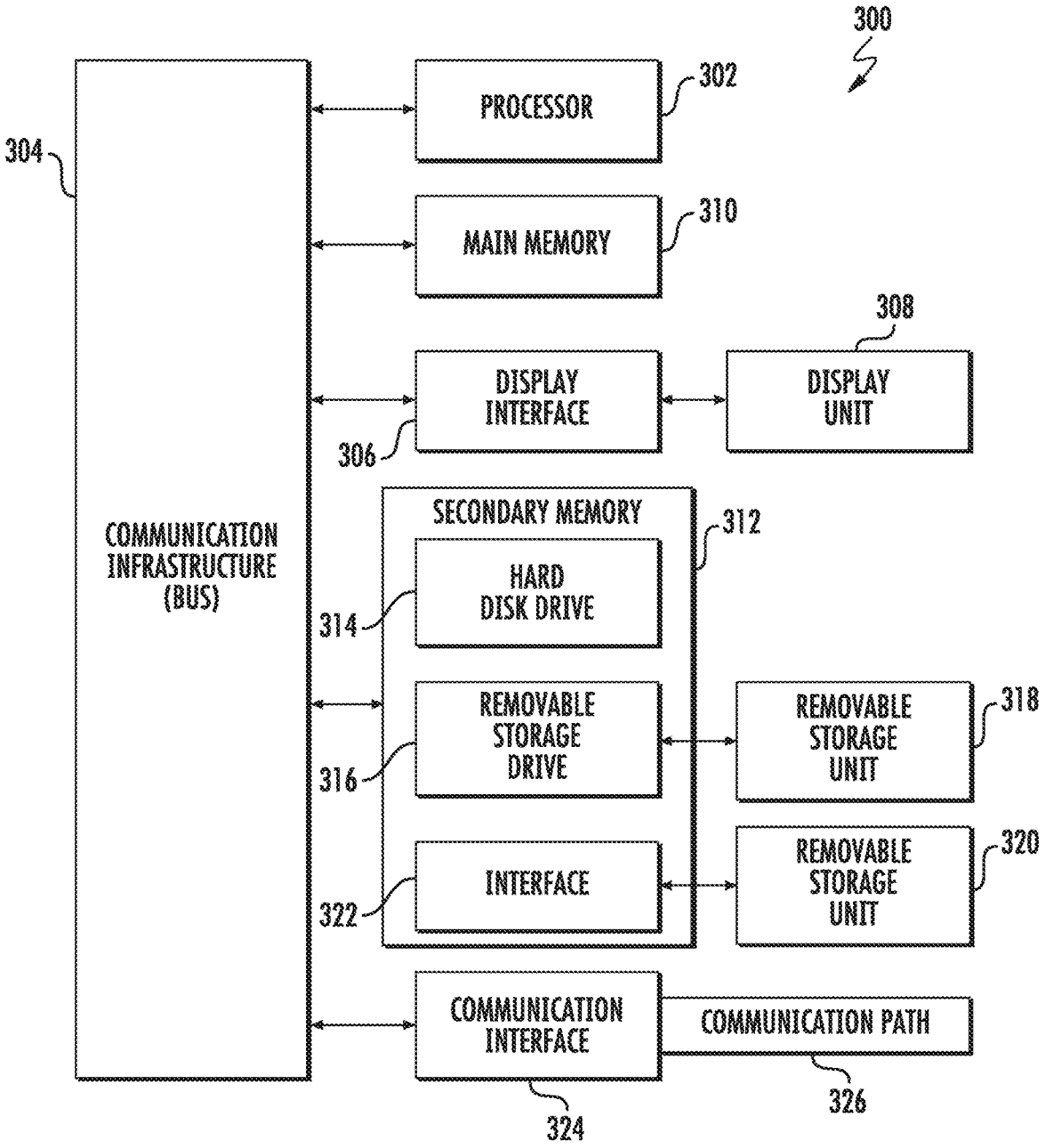
FIG. 3 is a block diagram illustrating an exemplary computer system.

FIG. 3 depicts a high-level block diagram of a computer system 300, which can be used to implement one or more embodiments. More specifically, computer system 300 can be used to implement hardware components of systems capable of performing methods described herein. Although one exemplary computer system 300 is shown, computer system 300 includes a communication path 326, which connects computer system 300 to additional systems (not depicted) and can include one or more wide area networks (WANs) and/or local area networks (LANs) such as the Internet, intranet(s), and/or wireless communication network(s). Computer system 300 and additional system are in communication via communication path 326, e.g., to communicate data between them. While numerous components are illustrated in FIG. 3, some embodiments might not include every illustrated component.

Computer system 300 includes one or more processors, such as processor 302. Processor 302 is connected to a communication infrastructure 304 (e.g., a communications bus, cross-over bar, or network). Computer system 300 can include a display interface 306 that forwards graphics, textual content, and other data from communication infrastructure 304 (or from a frame buffer not shown) for display on a display unit 308. Computer system 300 also includes a main memory 310, preferably random access memory (RAM), and can also include a secondary memory 312. Secondary memory 312 can include, for example, a hard disk drive 314 and/or a removable storage drive 316, representing, for example, a floppy disk drive, a magnetic tape drive, or an optical disc drive. Hard disk drive 314 can be in the form of a solid state drive (SSD), a traditional magnetic disk drive, or a hybrid of the two. There also can be more than one hard disk drive 314 contained within secondary memory 312. Removable storage drive 316 reads from and/or writes to a removable storage unit 318 in a manner well known to those having ordinary skill in the art. Removable storage unit 318 represents, for example, a floppy disk, a compact disc, a magnetic tape, or an optical disc, etc. which is read by and written to by removable storage drive 316. As will be appreciated, removable storage unit 318 includes a computer-readable medium having stored therein computer software and/or data.

In alternative embodiments, secondary memory 312 can include other similar means for allowing computer programs or other instructions to be loaded into the computer system. Such means can include, for example, a removable storage unit 320 and an interface 322. Examples of such means can include a program package and package interface (such as that found in video game devices), a removable memory chip (such as an EPROM, secure digital card (SD card), compact flash card (CF card), universal serial bus (USB) memory, or PROM) and associated socket, and other removable storage units 320 and interfaces 322 which allow software and data to be transferred from the removable storage unit 320 to computer system 300.

Computer system 300 can also include a communications interface 324. Communications interface 324 allows software and data to be transferred between the computer system and external devices. Examples of communications interface 324 can include a modem, a network interface (such as an Ethernet card), a communications port, or a PC card slot and card, a universal serial bus port (USB), and the like. Software and data transferred via communications interface 324 are in the form of signals that can be, for example, electronic, electromagnetic, optical, or other signals capable of being received by communications interface 324. These signals are provided to communications interface 324 via communication path (i.e., channel) 326. Communication path 326 carries signals and can be implemented using wire or cable, fiber optics, a phone line, a cellular phone link, an RF link, and/or other communications channels.

In the present description, the terms "computer program medium," "computer usable medium," and "computer-readable medium" are used to refer to media such as main memory 310 and secondary memory 312, removable storage drive 316, and a hard disk installed in hard disk drive 314. Computer programs (also called computer control logic) are stored in main memory 310 and/or secondary memory 312. Computer programs also can be received via communications interface 324. Such computer programs, when run, enable the computer system to perform the features discussed herein. In particular, the computer programs, when run, enable processor 302 to perform the features of the computer system. Accordingly, such computer programs represent controllers of the computer system. Thus it can be seen from the forgoing detailed description that one or more embodiments provide technical benefits and advantages.

Figure 4:
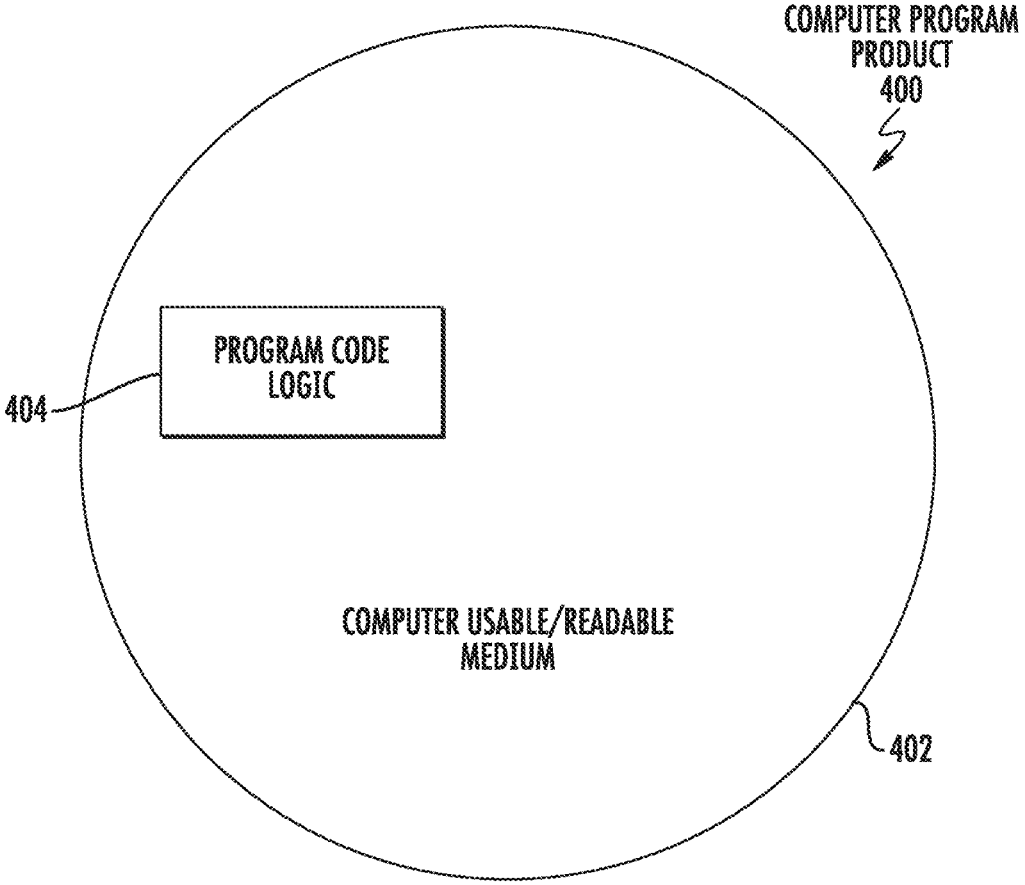
FIG. 4 illustrates a computer program product.

Referring now to FIG. 4, a computer program product 400 in accordance with an embodiment that includes a computer-readable storage medium 402 and program instructions 404 is generally shown.

Embodiments can be a system, a method, and/or a computer program product. The computer program product can include a computer-readable storage medium (or media) having computer-readable program instructions thereon for causing a processor to carry out aspects of embodiments of the present disclosure.

The computer-readable storage medium can be a tangible device that can retain and store instructions for use by an instruction execution device. The computer-readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer-readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer-readable program instructions described herein can be downloaded to respective computing/processing devices from a computer-readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers, and/or edge servers. A network adapter card or network interface in each computing/processing device receives computer-readable program instructions from the network and forwards the computer-readable program instructions for storage in a computer-readable storage medium within the respective computing/processing device.

Computer-readable program instructions for carrying out embodiments can include assembler instructions, instruction-set-architecture (ISA) instructions, machine instructions, machine dependent instructions, microcode, firmware instructions, state-setting data, or either source code or object code written in any combination of one or more programming languages, including an object-oriented programming language such as Smalltalk, C++ or the like, and conventional procedural programming languages, such as the "C" programming language or similar programming languages. The computer-readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer-readable program instructions by utilizing state information of the computer-readable program instructions to personalize the electronic circuitry, in order to perform embodiments of the present disclosure.

Aspects of various embodiments are described herein with reference to flowchart illustrations and/or block diagrams of methods, apparatus (systems), and computer program products according to various embodiments. It will be understood that each block of the flowchart illustrations and/or block diagrams, and combinations of blocks in the flowchart illustrations and/or block diagrams, can be implemented by computer-readable program instructions.

These computer-readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer-readable program instructions can also be stored in a computer-readable storage medium that can direct a computer, a programmable data processing apparatus, and/or other devices to function in a particular manner, such that the computer-readable storage medium having instructions stored therein comprises an article of manufacture including instructions which implement aspects of the function/act specified in the flowchart and/or block diagram block or blocks.

The computer-readable program instructions can also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams can represent a module, segment, or portion of instructions, which comprises one or more executable instructions for implementing the specified logical function(s). In some alternative implementations, the functions noted in the block can occur out of the order noted in the figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The descriptions presented herein are for purposes of illustration and description, but is not intended to be exhaustive or limited. Many modifications and variations will be apparent to those of ordinary skill in the art without departing from the scope and spirit of embodiments of the present disclosure. The embodiment was chosen and described in order to best explain the principles of operation and the practical application, and to enable others of ordinary skill in the art to understand embodiments of the present disclosure for various embodiments with various modifications as are suited to the particular use contemplated.

What is claimed is:

1. A method comprising:

sensing or predicting rain in a proximity of an air conditioning unit;

powering a fan, the fan configured to push or pull air and the rain through the air conditioning unit;

determining a most recent sensing or predicting of rain, wherein:

powering the fan only occurs if the most recent sensing of rain is greater than a predetermined amount of time or amount of rain.

2. The method of claim 1 wherein the fan is powered for a second predetermined amount of time upon the sensing of rain.

3. The method of claim 2 wherein the second predetermined amount of time is less than one hour.

4. The method of claim 1 wherein the fan is configured to turn on in a periodic manner while rain is being sensed.

5. The method of claim 1 wherein the predetermined amount of time is one week.

6. A method comprising:

sensing or predicting rain in a proximity of an air conditioning unit;

powering a fan, the fan configured to push or pull air and the rain through the air conditioning unit;

wherein sensing or predicting rain comprises:

receiving a forecast of rain, including a forecast time of a commencement of rain and amount of rain; wherein:

powering the fan occurs at the forecast time of the commencement of rain, or after a predetermined delay period after the forecast time of the commencement of rain.

7. A system comprising:

a condenser of an air conditioning system;

a rain sensor; and a fan coupled to the rain sensor; wherein:

the fan is configured to operate upon a sensing of rain by the rain sensor; and the fan is configured to drive air and rain through the condenser;

a controller coupled between the rain sensor and the fan, the controller configured to:

determine a most recent sensing of rain; and power the fan only if the most recent sensing of rain is greater than a predetermined amount of time.

8. The system of claim 7 wherein:

the controller is configured to cause the fan to operate for a second predetermined amount of time upon the sensing of rain.

9. The system of claim 8 wherein the second predetermined amount of time is less than one hour.

10. The system of claim 8 wherein the fan is configured to turn on in a periodic manner while rain is being sensed or during a time duration during which rain is forecasted to fall.

11. The system of claim 7 wherein the predetermined amount of time is one week.

12. A system comprising:

a condenser of an air conditioning system;

a rain sensor; and a fan coupled to the rain sensor; wherein:

the fan is configured to operate upon a sensing of rain by the rain sensor; and the fan is configured to drive air and rain through the condenser;

a controller coupled between the rain sensor and the fan, the controller configured to:

receive a forecast of rain, including a forecast time of a commencement of rain; wherein:

power the fan at the forecast time of the commencement of rain, or after a predetermined delay period after the forecast time of the commencement of rain.

13. A computer program product, the computer program product comprising a computer readable storage medium having program instructions embodied therewith, wherein the computer readable storage medium is not a transitory signal per se, the program instructions executable by a processor to cause the processor to:

receive an indication of rainfall in a proximity of a condenser of an air conditioning unit;

cause the powering of a fan upon receiving the indication of rainfall, the fan configured to push or pull air and the rain through the condenser;

determine a most recent sensing of rain;

wherein causing powering the fan only occurs if the most recent sensing of rain is greater than a predetermined amount of time.

14. The computer program product of claim 13 wherein the fan is powered for a second predetermined amount of time upon the sensing of rain.

15. The computer program product of claim 14 wherein the second predetermined amount of time is less than one hour.

16. The computer program product of claim 14 wherein the fan is configured to turn on in a periodic manner while rain is being sensed.

17. A computer program product, the computer program product comprising a computer readable storage medium having program instructions embodied therewith, wherein the computer readable storage medium is not a transitory signal per se, the program instructions executable by a processor to cause the processor to:

receive an indication of rainfall in a proximity of a condenser of an air conditioning unit;

cause the powering a fan upon receiving the indication of rainfall, the fan configured to push or pull air and the rain through the condenser;

wherein receiving an indication of rainfall sensing rain comprises:

receiving a forecast of rain, including a forecast time of a commencement of rain and amount of rain; wherein:

causing powering the fan occurs at the forecast time of the commencement of rain.

* * * * *